US006066593A

United States Patent [19]

Obata et al.

[11] Patent Number: 6,066,593

[45] Date of Patent: May 23, 2000

[54] THERMAL TRANSFER SHEET

[75] Inventors: Kei Obata; Hiroaki Ogasawara, both of Miyagi; Huy Sam, Tokyo; Masayoshi Isago, Miyagi, all of Japan

[73] Assignee: Sony Corporation, Tokyo, Japan

[21] Appl. No.: 09/048,020

[22] Filed: Mar. 26, 1998

[30] Foreign Application Priority Data

Mar. 27, 1997 [JP] Japan ..... 9-075521

[51] Int. Cl.[7] ..... B41M 5/035; B41M 5/38

[52] U.S. Cl. ..... 503/227; 428/195; 428/704; 428/913; 428/914

[58] Field of Search ..... 8/471; 428/195, 428/704, 913, 914; 503/227

[56] References Cited

U.S. PATENT DOCUMENTS

| | | | |
|---|---|---|---|
| 4,720,480 | 1/1988 | Ito et al. | 503/227 |
| 4,981,748 | 1/1991 | Kawai et al. | 428/126 |
| 5,409,882 | 4/1995 | Minato et al. | 503/227 |

*Primary Examiner*—Bruce H. Hess
*Attorney, Agent, or Firm*—Hill & Simpson

[57] ABSTRACT

A thermal transfer sheet having a base sheet; a thermal transfer dye layer formed on the front side of the base sheet; and a heat resisting and lubricating layer formed on the reverse side of the base sheet. Even if the thermal transfer dye layer contains an indoaniline dye, deterioration in the indoaniline dye can be prevented, the preservability of the thermal transfer can be maintained, fusion of the thermal transfer sheet to a thermal head can be prevented and smooth movement of the thermal transfer sheet is enabled. Thus, sticking which occurs during a printing operation can be prevented. The thermal transfer sheet according to the present invention has a base sheet; a thermal transfer dye layer formed on the right side of the base sheet; and a heat resisting and lubricating layer formed on the reverse side of the base sheet, wherein the thermal transfer dye layer contains an indoaniline dye, and the heat resisting and lubricating layer contains polyoxyethylene sorbitol fatty acid ester and phosphoric ester at a weight ratio of 10:1 to 1:2.

6 Claims, 3 Drawing Sheets

THERMAL TRANSFER SHEET

BACKGROUND OF THE INVENTION

1. Field of the Invention

The present invention relates to a thermal transfer sheet exhibiting excellent stability during preservation.

2. Prior Art

In recent years, a dye-sublimation thermal transfer recording method using a thermal transfer sheet having a thermal transfer dye layer, which contains a sublimation dye and which is formed on a base sheet thereof, has been widely used. A printing operation with the dye-sublimation thermal transfer recording method is performed in such a manner that the thermal transfer dye layer is heated in considerably short time to cause color dots in a multiplicity of colors and composed of the sublimation dye to be transferred to transfer paper. Thanks to the dots in the multiplicity of colors, a full color image of an original document can be reproduced. To realize a satisfactorily wide color reproducible range, indoaniline dyes have widely been employed in place of azo dyes, anthraquinone dyes and methine dyes.

A thermal head is brought into contact with the base sheet of the thermal transfer sheet so that heat required to perform the printing operation is applied. To prevent fusion of the thermal transfer sheet to the thermal head and to enable the thermal transfer sheet to move smoothly, a heat resisting and lubricating layer is formed on the reverse side of the base sheet (that is, a surface of the base sheet opposite to the thermal transfer dye layer).

The color density realized when the dye in the thermal transfer dye layer is transferred to the photographic paper is in proportion to the heating value which is applied from the thermal head. Therefore, the surface temperature of the thermal head must be changed in a range in units of some hundreds of degrees to realize satisfactory gradations in densities of each color. Therefore, the thermal transfer sheet and the thermal head move relatively while being in contact with each other. However, change in the surface temperature of the thermal head results in occurrence of change in the coefficient of friction between the thermal head and the heat resisting and lubricating layer of the thermal transfer. Thus, there arises the following problems.

If the coefficient of friction between the thermal head and the heat resisting and lubricating layer is changed, the thermal transfer sheet cannot easily be moved at predetermined speed. As a result, a sharp image cannot be formed. If the coefficient of friction is too large, the moving speed of the thermal transfer sheet is temporarily reduced. Thus, linear inconsistencies called "sticking" takes place which excessively raises the density of the formed image.

To prevent "sticking", the coefficient of friction at high temperatures must be reduced. As a lubricant for reducing the coefficient of friction at high temperatures, an attempt to use a phosphoric ester has been made.

If the indoaniline dye is employed as a sublimation dye in the thermal transfer dye layer in cyan, there arises a problem. That is, if a thermal transfer sheet comprising a heat resisting and lubricating layer, which contains a phosphoric ester lubricant having a high acidity, is rolled, the heat resisting and lubricating layer and the thermal transfer dye layer are brought into direct contact with each other. As a result, the indoaniline dye, which can easily be decomposed under an acidic condition, deteriorates. It leads to a fact that preservability of the thermal transfer sheet deteriorates and also the density of the printed image is lowered.

OBJECT AND SUMMARY OF THE INVENTION

In view of the foregoing, an object of the present invention is to provide a thermal transfer sheet having a base sheet; a thermal transfer dye layer formed on the front side of the base sheet; and a heat resisting and lubricating layer formed on the reverse side of the base sheet. Even if the thermal transfer dye layer contains an indoaniline dye, deterioration in the indoaniline dye can be prevented, the preservability of the thermal transfer can be maintained, fusion of the thermal transfer sheet to a thermal head can be prevented and smooth movement of the thermal transfer sheet is enabled. Thus, sticking which occurs during a printing operation can be prevented.

The inventor of the present invention found a fact that the above-mentioned object can be obtained when polyoxyethylene sorbitol fatty acid ester and phosphoric ester are used at a specific ratio in the heat resisting and lubricating layer. Thus, the present invention was established.

According to one aspect of the present invention, there is provided a thermal transfer sheet according to the present invention having a base sheet; a thermal transfer dye layer formed on the front side of the base sheet; and a heat resisting and lubricating layer formed on the reverse side of the base sheet, wherein the thermal transfer dye layer contains an indoaniline dye, and the heat resisting and lubricating layer contains polyoxyethylene sorbitol fatty acid ester and phosphoric ester at a weight ratio of 10:1 to 1:2.

Other objects, features and advantages of the invention will be evident from the following detailed description of the preferred embodiments described in conjunction with the attached drawings.

DETAILED DESCRIPTION OF THE INVENTION

A thermal transfer sheet according to the present invention will now be described with reference to the drawings.

Figure 1:
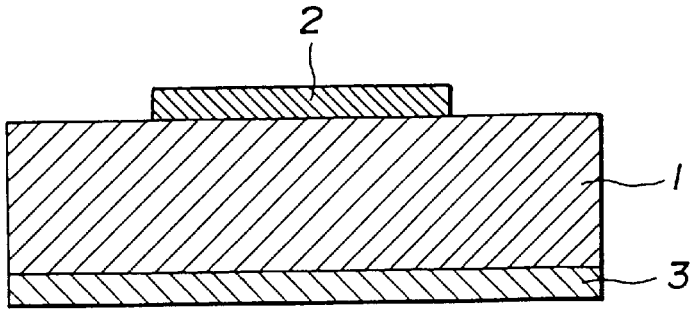
FIG. 1 is a schematic plan view showing a thermal transfer sheet according to the present invention.

The thermal transfer sheet according to the present invention comprises a thermal transfer dye layer 2 formed on the surface of a base sheet 1, as shown in FIG. 1. Moreover, a heat resisting and lubricating layer 3 is formed on the reverse side of the base sheet 1.

The thermal transfer dye layer 2 has a structure in which an indoaniline dye is dispersed in a binder thereof. The indoaniline dye may be a single dye or a combination of a plurality of indoaniline dyes. In addition to the indoaniline dye, the following known dyes may be employed: an anthraquinone dye, a naphthoquinone dye, a heterocyclic azo dye and so forth. Note that the indoaniline dye is a known cyan dye.

It is preferable that the indoaniline dye is a compound expressed by the following formula (1):

(1)

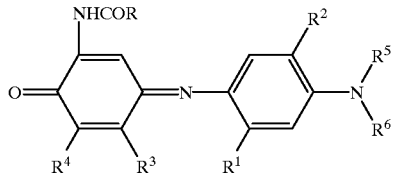

wherein R is an alkyl group or an alkoxy group, $R^1$, $R^2$, $R^3$, $R^4$, $R^5$ and $R^6$ are independently a hydrogen atom, an alkyl group, an alkoxy group, a formamino group, an alkylcarbonyl amino group, aryl carbonyl amino group or a halogen atom.

The binder for forming the thermal transfer dye layer 2 is not limited particularly. Therefore, the binder may be made of water soluble resin such as cellulose resin, acrylic acid resin or starch type resin; organic solvent such as a polyacryl ester, a polyphenylene oxide, polysulfone, polyether sulfone, ethylcellulose or acetylcellulose; or water soluble resin. To realize a high recording sensitivity and satisfactory preservability of the transfer member, it is preferable that a material having a thermal deformation temperature of 70° C. to 150° C. is employed. The material is exemplified by polystyrene, polyvinyl butyral, polycarbonate, methacrylic resin, acrylonitrile, a styrene copolymer, polyester resin, urethane resin, chlorinated polyethylene and chlorinated polypropylene.

The thermal transfer dye layer 2 can be formed as follows: the indoaniline dye, solvent and another dye, which is employed if necessary, are uniformly mixed with the binder to prepare a coating material for forming the thermal transfer dye layer. The coating material is applied to the surface of the base sheet 1 by a known method, after which the coating material is dried.

The heat resisting and lubricating layer 3 has a structure in which polyoxyethylene sorbitol fatty acid ester and phosphoric ester serving as lubricants are, at a ratio of 10:1 to 1:2, dispersed in the binder resin. When the polyoxyethylene sorbitol fatty acid ester and the phosphoric ester are employed at the above-mentioned specific ratio, the thermal transfer sheet is able to move on the thermal head at predetermined speed. As a result, a sharp image can be formed. When the thermal transfer sheet formed into a reel shape is stored, decrease in the density which is caused because of deterioration in the indoaniline dye can be prevented.

The ratio of the polyoxyethylene sorbitol fatty acid ester and the phosphoric ester will now be described. If the ratio of the polyoxyethylene sorbitol fatty acid ester is higher than 10/1 of the phosphoric ester, sticking cannot be prevented. If the ratio is lower than 1/2, the indoaniline dye deteriorates during storage of the thermal transfer sheet. In this case, the density of a formed image is lowered excessively.

It is preferable that the polyoxyethylene sorbitol fatty acid ester according to the present invention is a compound expressed by the following formula (2):

(2)

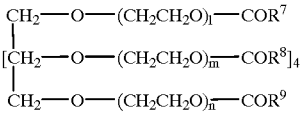

wherein $R^7$, $R^8$ and $R^9$ are independently a hydrogen atom or a straight chain acyl group having 12 to 18 carbon atoms, each of l, m and n is a number larger than 0, and $R^7$, $R^8$ and $R^9$ are not simultaneously hydrogen atoms.

The polyoxyethylene sorbitol fatty acid ester is exemplified by polyoxyethylene hexastearate (6) sorbitol, polyoxyethylene tetraolate (30) sorbitol and the like.

The phosphoric ester is exemplified by polyoxyethylene alkylether phosphoric ester.

If the contents of the polyoxyethylene sorbitol fatty acid ester and the phosphoric ester in the heat resisting and lubricating layer 3 are too small, the effect of reducing the coefficient of friction becomes unsatisfactory. If the quantities of the above-mentioned materials are too large, an insufficient result of drying occurs when a film is formed. Moreover, a problem of blocking arises in a coiled state. Therefore, it is preferable that the contents are 10 wt % to 50 wt %.

The binder resin in the heat resisting and lubricating layer 3 may be a known material which is cellulose acetate, polyvinyl acetal or acrylic resin. If necessary, a lubricant, a filler and a polyisocyanate compound may be added to the binder resin.

The filler may be an inorganic filler such as silica, talc, clay, zeolite, a titanium oxide, a zinc oxide or carbon; or an organic filler such as silicon resin, teflon resin or benzoguanamine resin.

The polyisocyanate compound is only required to have two or more isocyanate groups in the molecule thereof. The polyisocyanate compound is exemplified by tolylenediisocyanate, 4,4-diphenylmethane diisocyanate, 4,4-xylenediisocyanate, hexamethylenediisocyanate, 4,4-methylene bis(cyclohexylisocyanate), methylcyclohexane-2,4(or 2,6)-diisocyanate, 1,3-di(isocyanatemethyl) cyclohexane, isophoronediisocyanate and trimethyl·hexamethylene diisocyanate. An aduct (polyisocyanate prepolymer) of polyisocyanate prepared by partial addition reaction between diisocyanate and polyol or an aduct prepared by reaction between trilenediisocyanate and trimethylolpropane may be employed.

The heat resisting and lubricating layer 3 can be formed by uniformly mixing polyoxyethylene sorbitol fatty acid ester, a lubricant, additives (the filler, the polyisocyanate compound and the like) which are employed if necessary, and the solvent with the binder resin. Thus, the coating material for forming the heat resisting and lubricating layer is prepared, which is applied to the reverse side of the base sheet 1 by a usual method, and then dried.

The base sheet 1 may be a usual sheet-shape base material. The base sheet 1 may be a polyester film, a polystyrene film, a polypropylene film, a polysulfone film, a polycarbonate film, a polyimide film or an aramide film. The required thickness of the base sheet 1 is 1 μm to 30 μm, preferably 2 μm to 10 μm.

A specific structure of the thermal transfer sheet according to the present invention will now be described with reference to the drawings.

Figure 2:
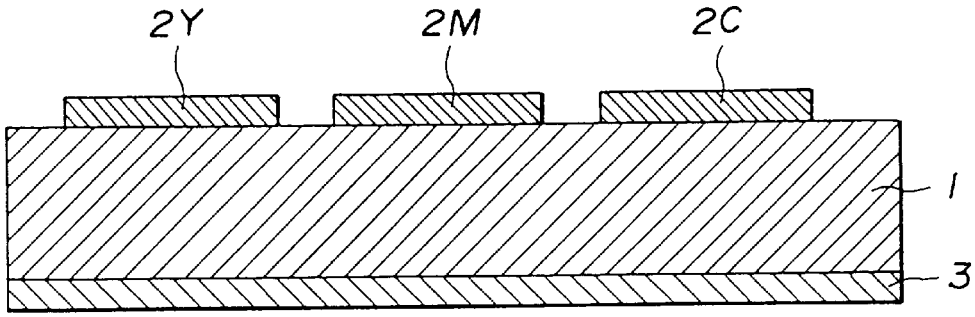
FIG. 2 is a cross sectional view showing another structure of the thermal transfer sheet according to the present invention.

FIG. 2 is a schematic cross sectional view showing an example of the structure of the thermal transfer sheet according to the present invention. FIGS. 3 to 7 are schematic plan views showing other structures of the thermal transfer sheet according to the present invention.

The thermal transfer sheet shown in FIG. 2 has a structure that at least one of thermal transfer dye layers 2Y (yellow), 2M (magenta) and 2C (cyan) contains the indoaniline dye. In this case, the known dyes, for example, the anthraquinone dye, naphthoquinone dye, heterocyclic azo dye and the like may be contained in addition to the indoaniline dye. The sequential order in which the thermal transfer dye layers are stacked is not limited specifically. The order may arbitrarily be determined as desired. A sensor mark 4 for detecting the position of the sheet may be formed on the surface of the base sheet 1, as shown in FIG. 3.

The thermal transfer dye layers 2Y and 2M for yellow and magenta except for cyan may contain known dyes. The yellow dye may be an azo dye, a disazo dye, a methine dye, a styryl dye, a pyridone·azo dye or their mixture. The magenta dye may be an azo dye, an anthraquinone dye, a styryl dye, a heterocyclic azo dye or their mixture.

Figure 3:
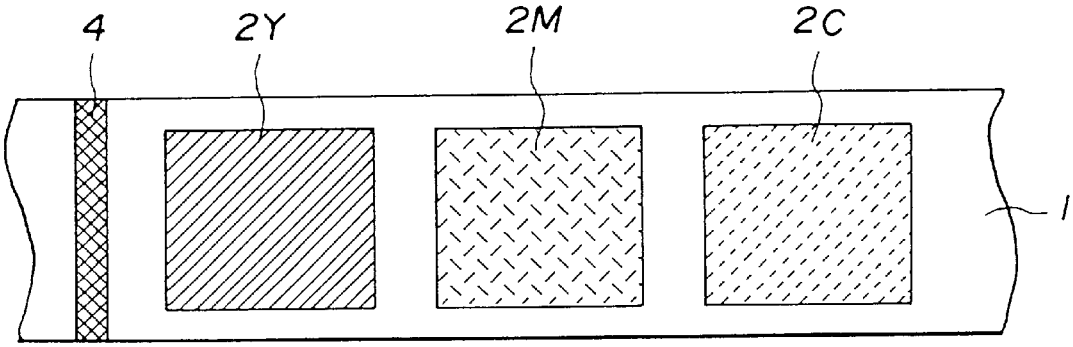
FIG. 3 is a plan view showing another structure of the thermal transfer sheet according to the present invention.
Figure 4:
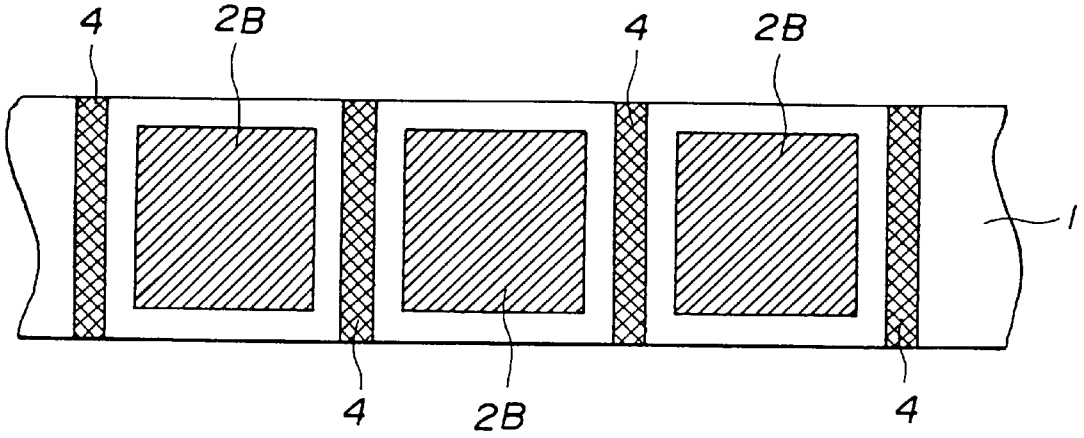
FIG. 4 is a plan view showing another structure of the thermal transfer sheet according to the present invention.
Figure 5:
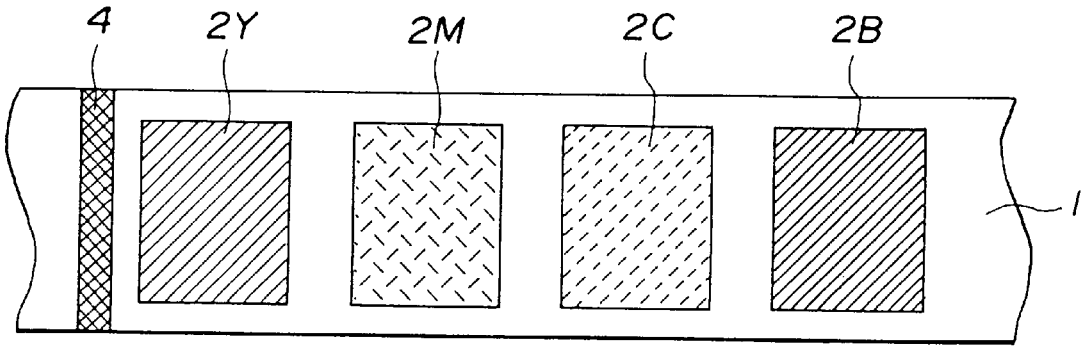
FIG. 5 is a plan view showing another structure of the thermal transfer sheet according to the present invention.
Figure 6:
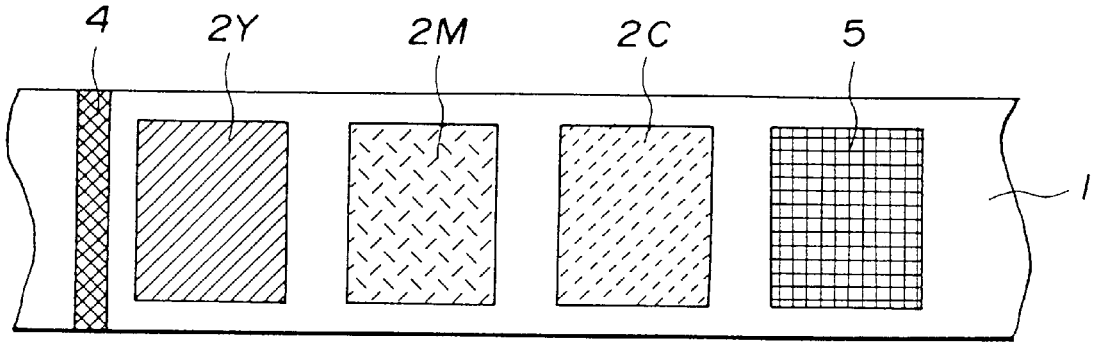
FIG. 6 is a plan view showing another structure of the thermal transfer sheet according to the present invention.
Figure 7:
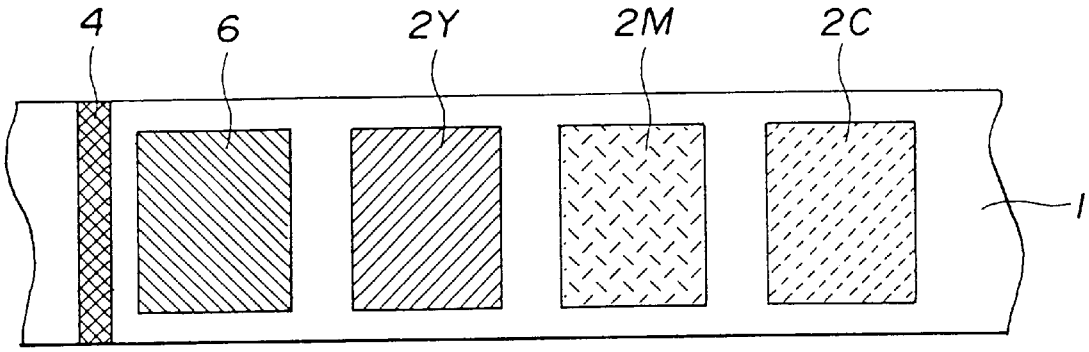
FIG. 7 is a plan view showing another structure of the thermal transfer sheet according to the present invention.

Although the indoaniline dye may be contained in only the thermal transfer dye layer 2C in cyan shown in FIG. 2 or FIG. 3, another color thermal transfer dye layer, for example, the thermal transfer dye layer 2B in black may be formed on the base sheet 1 if the indoaniline dye is employed as shown in FIG. 4. As shown in FIG. 5, the thermal transfer dye layer 2Y in yellow, the thermal transfer dye layer 2M in magenta, the thermal transfer dye layer 2C in cyan and the thermal transfer dye layer 2B in black may be formed on the base sheet 1. In addition to the thermal transfer dye layers 2Y, 2M and 2C, a transfer protective layer 5 arranged to be transferred to the printed surface after the printing operation has been performed to protect the printed surface may be formed on the base sheet 1, as shown in FIG. 6. As shown in FIG. 7, a transfer-type receptor layer 6 may be provided so as to be transferred to plain paper.

As described above, the thermal transfer sheet according to the present invention has the structure that the heat resisting and lubricating layer containing the lubricant comprising the polyoxyethylene sorbitol fatty acid ester and the phosphoric ester at a specific ratio. Therefore, even if an indoaniline dye is employed as the dye in the thermal transfer dye layer, deterioration in the indoaniline dye can be prevented. Thus, preservability of the thermal transfer sheet can be maintained and fusion of the thermal transfer sheet to the thermal head can be prevented. Moreover, the thermal transfer sheet is enabled to smoothly move and sticking occurring during the printing operation can be prevented.

EXAMPLES

Examples 1 to 6 and Comparative Examples 1 to 6

A method of manufacturing the thermal transfer sheet will now be described.

Each of ink compositions shown in Table 1 containing dyes shown in Table 2 was applied to the surface of a base sheet made of a polyester film ("LUMILER" trade name of Toray) having a thickness of 6 $\mu$m. Each of ink compositions was applied to have a dry thickness of 1 $\mu$m. Thus, thermal transfer dye layers were formed.

Then, compositions for forming heat resisting and lubricating layers shown in Table 3 containing polyoxyethylene sorbitol fatty acid ester and phosphoric ester shown in Table 4 were applied to the reverse side of each base sheet to which the thermal transfer dye layer was applied. The heat resisting and lubricating layer was applied to have a dry thickness of 1 $\mu$m. Then, a drying process was performed so that heat resisting and lubricating layers were formed. As a result, thermal transfer sheets were manufactured.

TABLE 1

| Contents in Ink | | Quantity Blended (parts by weight |
|---|---|---|
| Indoaniline Dye (Dye A, B or C) shown in Table 2 | | 5.0 |
| Example 1 | A | |
| Example 2 | A | |
| Example 3 | B | |
| Example 4 | B | |
| Example 5 | C | |
| Example 6 | C | |
| Comparative Example 1 | A | |
| Comparative Example 2 | B | |
| Comparative Example 3 | A | |
| Comparative Example 4 | C | |
| Comparative Example 5 | A | |
| Comparative Example 6 | B | |
| Polyvinyl Butyral Resin (BX-1 manufactured by Sekisui Chemical) | | 5.0 |
| Methylethylketone | | 45.0 |
| Toluene | | 45.0 |

TABLE 2

| (Indoaniline Dye) Substituent in Formula (1) | Dye A | Dye B | Dye C |
|---|---|---|---|
| R | Ethoxy | Methyl | Ethoxy |
| $R^1$ | Methyl | Methyl | Hydrogen |
| $R^2$ | Hydrogen | Hydrogen | Chlorine |
| $R^3$ | Methyl | Hydrogen | Hydrogen |
| $R^4$ | Chlorine | Hydrogen | Hydrogen |
| $R^5$ | Ethyl | Propyl | Hydrogen |
| $R^6$ | Ethyl | Propyl | Ethyl |

TABLE 3

| (Composition for Forming Heat and Lubricating Layer) Components | Resisting Quantity Blended (parts by weight) |
|---|---|
| Polyvinylacetal Resin (DENXA BUTYRAL #3000K manufactured by Electro Chemical Industry) | 5.0 |
| Polyisocyanate Cross Linking Agent (COLONATE-L manufactured by Nippon Polyurethane) | 0.5 |
| Polyoxyethylene Sorbitol Fatty Acid Ester Shown in Table 4 | X |
| Phosphoric Ester Shown in Table 4 | Y |
| Silica (Filler) (Nipsil E-200A manufactured by Nippon Silica) | 0.5 |
| Methylethylketone | (94-X-Y)/2 |
| Toluene | (94-X-Y)/2 |

TABLE 4

| | Polyoxyethylene Sorbitol Fatty Acid Ester | X parts by weight | Phosphoric Ester | Y parts by weight |
|---|---|---|---|---|
| Examples 1 | Polyoxyethylene Hexastearate (6) Sorbitol *1 | 20 | PHOSPANOL RL-210 | 2 |

TABLE 4-continued

| | Polyoxyethylene Sorbitol Fatty Acid Ester | X parts by weight | Phosphoric Ester | Y parts by weight |
|---|---|---|---|---|
| Examples 2 | Polyoxyethylene Tetraoleate (6) Sorbit *2 | 10 | PHOSPANOL RS-410 | 20 |
| Examples 3 | Polyoxyethylene Tetrastearate (60) Sorbitol *3 | 5 | PHOSPANOL RD-720 | 5 |
| Examples 4 | Polyoxyethylene Monolaurate (6) Sorbitol *4 | 30 | PHOSPANOL RD-720 | 20 |
| Examples 5 | Polyoxyethylene Tetraoleate (40) Sorbit *5 | 10 | PHOSPANOL RL-210 | 10 |
| Examples 6 | Polyoxyethylene Hexastearate (6) Sorbit *1 | 20 | PHOSPANOL RS-410 | 10 |
| Comparative Examples 1 | Polyoxyethylene Tetraoleate (6) Sorbit *2 | 30 | PHOSPANOL RL-210 | 2 |
| Comparative Examples 2 | Polyoxyethylene Tetrastearate (60) Sorbitol *3 | 4 | PHOSPANOL RS-410 | 4 |
| Comparative Examples 3 | Butyl Stearate *6 | 10 | PHOSPANOL RL-210 | 10 |
| Comparative Examples 4 | Myristic Acid *7 | 20 | PHOSPANOL RS-410 | 20 |
| Comparative Examples 5 | Polyoxyethylene Monolaurate (6) Sorbitol *8 | 10 | PHOSPANOL RD-720 | 25 |
| Comparative Examples 6 | Polyoxyethylene Tetraoleate (40) Sorbit *5 | 30 | PHOSPANOL RL-210 | 30 |

(Note)
*1: NIKKOL GS-6,
*2: NIKKOL GO-4,
*3: NIKKOL GS-460,
*4: NIKKOL GL-1,
*5: NIKKOL GO-440,
*6: NIKKOL BS,
*8: NIKKOL GL-1S (manufactured by Nikko Chemical),
*7: Lunac MY-98 (manufactured by Kao) and all of phosphoric esters were manufactured by Toho Chemical)

The thermal transfer sheets according to Examples 1 to 6 and Comparative Examples 1 to 6 were mounted on a full-color printer (UP-D7000 manufactured by SONY). Then, images each having gradations (16 steps) were printed on photographic paper (UPC7010 manufactured by SONY) so that sticking was visually observed. Results free from sticking were evaluated as "○" and those suffered from sticking were evaluated as "x". Results were shown in Table 5.

Preservability of dye in the thermal transfer sheet was evaluated as follows: two 20 cm×20 cm thermal transfer sheets were obtained by cutting. Then, either thermal transfer dye layer and the other heat resisting and lubricating layer were superimposed, and then held between two glass plates and placed on a flat portion. Then, a weight which was 5 Kg in weight was placed on the glass plate, and they were introduced into an oven set to 50° C. (PHH-200 manufactured by Tabai) so as to be allowed to stand for 48 hours.

The stored thermal transfer sheet having the thermal transfer dye layer which was in contact with the heat resisting and lubricating layer was used in a gradation printing operation similarly to the operation performed to evaluate sticking. Then, the highest density of cyan images realized before and after the storage were measured by a Macbeth Densitometer (TR-924). A ratio (%) of the highest density of the stored image with respect to that before the storage was measured. Thus, the preservability of the dye was evaluated. Samples having the above-mentioned ratio not lower than 90% were evaluated as "○" and those having the same lower than 90% were evaluated as "x". Results were shown in Table 5.

TABLE 5

| | Sticking | Preservability of Dye |
|---|---|---|
| Example 1 | ○ | ○ |
| Example 2 | ○ | ○ |
| Example 3 | ○ | ○ |
| Example 4 | ○ | ○ |
| Example 5 | ○ | ○ |
| Example 6 | ○ | ○ |
| Comparative Example 1 | X | ○ |
| Comparative Example 2 | X | ○ |
| Comparative Example 3 | X | ○ |
| Comparative Example 4 | X | ○ |
| Comparative Example 5 | ○ | X |
| Comparative Example 6 | (evaluation was impossible) | (evaluation was impossible) |

As can be understood from Table 5, the thermal transfer sheets according to Examples 1 to 6 of the present invention were free from sticking which was caused from enlargement of friction, resulting in sharp images being obtained. Moreover, realized color density was maintained even after storage. All of images obtained with the samples according to the present invention maintained 90% or higher densities. Thus, excellent preservability of the dye was realized.

The thermal transfer sheets according to Comparative Examples 1 and 2 had the structure that the quantity of the phosphoric ester was too small with respect to that of the polyoxyethylene sorbitol fatty acid ester. The thermal transfer sheets according to Comparative Examples 3 and 4 had the structure that butyl stearate and myristic acid serving as lubricants were employed in place of the polyoxyethylene sorbitol fatty acid ester. The foregoing thermal transfer sheets according to the comparative examples encountered sticking. The thermal transfer sheet according to Comparative Example 5 having the structure that the quantity of the phosphoric ester was too large with respect to the polyoxyethylene sorbitol fatty acid ester encountered excessive lowering of the density after the storage.

The thermal transfer sheet according to Comparative Example 6 had the structure that the total quantity of the polyoxyethylene sorbitol fatty acid ester and the phosphoric ester exceeded 50 wt % of the heat resisting and lubricating layer. The foregoing thermal transfer sheet could not be dried under the same conditions as those under which the thermal transfer sheets according to Examples 1 to 6 were dried. Thus, any image could not be printed by the printer.

The thermal transfer sheet according to the present invention has the structure that the thermal transfer dye layer is formed on the front side of the base sheet and the heat resisting and lubricating layer is formed on the reverse side of the base sheet. Even if the indoaniline dye is contained in the thermal transfer dye layer, deterioration in the indoaniline dye can be prevented to maintain the preservability of the thermal transfer sheet. Moreover, fusion of the thermal transfer sheet to the thermal head can be prevented and smooth movement of the thermal transfer sheet is enabled. As a result, sticking occurring during a printing operation can be prevented.

Although the invention has been described in its preferred form with a certain degree of particularity, it is understood that the present disclosure of the preferred form can be changed in the details of construction and in the combination and arrangement of parts without departing from the spirit and the scope of the invention as hereinafter claimed.

What is claimed is:

1. A thermal transfer sheet comprising:

a base sheet;

a thermal transfer dye layer formed on the front side of said base sheet; and a heat resisting and lubricating layer formed on the reverse side of said base sheet, wherein said thermal transfer dye layer contains an indoaniline dye, and said heat resisting and lubricating layer contains polyoxyethylene sorbitol fatty acid ester and phosphoric ester at a weight ratio ranging from 10:1 to 3:2.

2. A thermal transfer sheet according to claim 1, wherein the indoaniline dye is a compound expressed by the following formula (1):

(1)

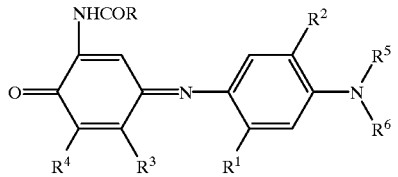

wherein R is an alkyl group or an alkoxy group, $R^1$, $R^2$, $R^3$, $R^4$, $R^5$ and $R^6$ are independently a hydrogen atom, an alkyl group, an alkoxy group, a formamino group, an alkylcarbonyl amino group, aryl carbonyl amino group or a halogen atom.

3. An thermal transfer sheet according to claim 1 or 2, wherein the polyoxyethylene sorbitol fatty acid ester is a compound expressed by the following formula (2):

(2)

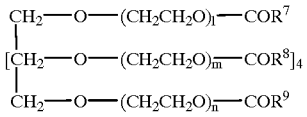

wherein $R^7$, $R^8$ and $R^9$ are independently a hydrogen atom or a straight chain acyl group having 12 to 18 carbon atoms, each of l, m and n is a number larger than 0, and $R^7$, $R^8$ and $R^9$ are not simultaneously hydrogen atoms.

4. A thermal transfer sheet according to claim 3, wherein the polyoxyethylene sorbitol fatty acid ester is polyoxyethylene hexastearate (6) sorbitol or polyoxyethylene tetraoleate (30) sorbitol.

5. A thermal transfer sheet according to claim 1, wherein the phosphoric ester is polyoxyethylene alkylether phosphate.

6. A thermal transfer sheet according to claim 1, wherein the content of the polyoxyethylene sorbitol fatty acid ester and the phosphoric ester in the heat resisting and lubricating layer is 10 wt % to 50 wt %.

* * * * *